US011472517B2

(12) United States Patent
Lin et al.

(10) Patent No.: US 11,472,517 B2
(45) Date of Patent: Oct. 18, 2022

(54) TRASH SKIMMER BOAT

(71) Applicant: Dalian University of Technology, Dalian (CN)

(72) Inventors: Yan Lin, Dalian (CN); Xiaoning Jiang, Dalian (CN); Yanyun Yu, Dalian (CN); Xuanyi Bian, Dalian (CN); Linmao Zhang, Dalian (CN)

(73) Assignee: DALIAN UNIVERSITY OF TECHNOLOGY, Dalian (CN)

( * ) Notice: Subject to any disclaimer, the term of this patent is extended or adjusted under 35 U.S.C. 154(b) by 128 days.

(21) Appl. No.: 16/941,571

(22) Filed: Jul. 29, 2020

(65) Prior Publication Data

US 2021/0276672 A1 Sep. 9, 2021

(30) Foreign Application Priority Data

Mar. 9, 2020 (CN) ..... 202010159360.1

(51) Int. Cl.
*B63B 35/32* (2006.01)
*B63B 1/12* (2006.01)
*E02B 15/04* (2006.01)

(52) U.S. Cl.
CPC ..... *B63B 35/32* (2013.01); *B63B 1/12* (2013.01); *E02B 15/046* (2013.01); *E02B 15/048* (2013.01)

(58) Field of Classification Search
CPC .. B63B 1/10; B63B 1/12; B63B 1/121; B63B 35/32; B63B 35/34; B63B 35/38; E02B 15/046; E02B 15/048
USPC ..... 114/61.1, 61.2, 61.22, 72, 292, 382; 210/242.1
See application file for complete search history.

(56) References Cited

U.S. PATENT DOCUMENTS 3,268,081 A * 8/1966 Menkee ..... E02B 15/046 210/523
3,730,119 A * 5/1973 Budris ..... B63B 35/32 210/242.3
4,322,294 A * 3/1982 Price ..... E02B 15/104 210/540
5,028,325 A * 7/1991 Hamilton ..... B63B 35/32 210/242.1
5,173,182 A * 12/1992 Debellian ..... E02B 15/046 114/61.1
5,456,197 A * 10/1995 Kwok ..... E02B 15/046 114/382

(Continued)

*Primary Examiner* — Daniel V Venne
(74) *Attorney, Agent, or Firm* — Matthias Scholl P.C.; Matthias Scholl

(57) ABSTRACT

A trash skimmer boat including a hull, a connection member, a transmission, a grille assembly, and a measuring member. The hull includes two pontoons and a gap between the two pontoons, and the two pontoons are symmetrical with respect to the gap. Each pontoon includes a deck, a bottom plate, a first side plate, a second side plate, a first sealing plate, a second sealing plate, and a third sealing plate. The connection member includes two longitudinal bars and two transverse bars connecting to one another to form an octothorpe-shaped frame. The transmission comprising a motor, a drive wheel, a driven wheel, a connection plate, and a conveyor belt. The grille assembly including a plurality of flat grilles and a curved grille. The measuring member including a T-shaped frame and a probe. The gap is disposed between two second side plates.

8 Claims, 15 Drawing Sheets

(56) References Cited

U.S. PATENT DOCUMENTS

| | | | | |
|---|---|---|---|---|
| 7,045,058 | B2 * | 5/2006 | Walczyk | E02B 15/048 210/242.1 |
| 11,001,351 | B1 * | 5/2021 | Aguilera | E02B 15/104 |
| 2006/0065586 | A1 * | 3/2006 | Walczyk | E02B 15/048 210/242.1 |

* cited by examiner 54
50
T
60
61
51
54
52
30
30a
54
50
30b
31
M
36
21
36
10b
45
10
40
22
22a
22
51
10a
54
52
22
54
52
50
22a
13
54
50
20
51
16
52
19a
13
19
11
12
10c
18
21
H
11d
17
33
36
10d
32
31
52
53
18a
11
20
30b
14
30

TRASH SKIMMER BOAT

CROSS-REFERENCE TO RELATED APPLICATIONS

Pursuant to 35 U.S.C. § 119 and the Paris Convention Treaty, this application claims foreign priority to Chinese Patent Application No. 202010159360.1 filed Mar. 9, 2020, the contents of which, including any intervening amendments thereto, are incorporated herein by reference. Inquiries from the public to applicants or assignees concerning this document or the related applications should be directed to: Matthias Scholl P. C., Attn.: Dr. Matthias Scholl Esq., 245 First Street, 18th Floor, Cambridge, Mass. 02142.

BACKGROUND

The disclosure relates to a trash skimmer boat.

SUMMARY

The disclosure provides a trash skimmer boat.

The trash skimmer boat comprises a hull, a connection member, a transmission, a grille assembly, and a measuring member.

The hull comprises two pontoons and a gap between the two pontoons, and the two pontoons are symmetrical with respect to the gap; each pontoon comprises a deck, a bottom plate, a first side plate, a second side plate, a first sealing plate, a second sealing plate, and a third sealing plate.

The connection member comprises two longitudinal bars and two transverse bars connecting to one another to form an octothorpe-shaped frame.

The transmission comprising a motor, a drive wheel, a driven wheel, a connection plate, and a conveyor belt.

The grille assembly comprising a plurality of flat grilles and a curved grille.

The measuring member comprising a T-shaped frame and a probe.

The gap is disposed between two second side plates; the two pontoons each further comprises a bulkhead dividing the pontoon into a front compartment and a rear compartment; the hull further comprises a trumpet-shaped opening formed by two front compartments and communicating with the gap, and a first square frame across the trumpet-shaped opening and connecting the two second side plates; the transmission further comprises a second square frame fixedly connected to the first square frame via an adjustment screw.

The two longitudinal bars are disposed on two decks of the two pontoons, respectively; the two transverse bars are disposed on the front compartment and the rear compartment of each of the two pontoons, respectively. The front compartment is non-watertight and comprises a buoyancy module; the two decks each comprise a first hole communicating with the front compartment; the first side plate comprises a second hole and a hatch door capable of moving back and forth to cover and uncover the second hole.

The rear compartment is watertight and comprises a balancing weight; and the two decks each comprise a third hole communicating with the rear compartment; the transmission is disposed in the gap between the two pontoons; the drive wheel and the driven wheel are disposed on two sides of the connection plate, respectively.

The deck comprises a pair of support plates; the transmission comprises a first end and a second end; the first end is fixed on the two decks via the pair of support plates; the second end is fixedly disposed on the second square frame.

The plurality of flat grilles comprises a first flat grille, a second flat grille, and a third flat grille hinged to each other; the first flat grille, the second flat grille, and the third flat grille each comprises a plurality of through holes; the curved grille is connected to two ends of the first flat grille; and the curved grille comprises a window; and the T-shaped frame comprises a transverse beam and a vertical beam; the transverse beam is fixed on the two longitudinal bars, and the probe is disposed on one end of the vertical beam.

The two longitudinal bars, the two transverse bars, the deck, and the bottom plate are fixed together via nuts; and two ends of each of the two longitudinal bars and the two transverse bars are provided with lifting lugs, respectively.

The junction of the deck of the first compartment and the first side plate is provided with a first slide rail; a junction of the bottom plate of the first compartment and the first side plate is provided with a second slide rail; the hatch door comprises a first sliding groove receiving the first slide rail and a second sliding groove receiving the second slide rail.

The deck comprises three pairs of support plates; each support plate comprises an axle hole; the first square frame comprises two first vertical plates and a first transverse plate connecting the two first vertical plates; the two first vertical plates are disposed on the two decks of the two pontoons, respectively; a waterline is disposed on two ends of the first side plate and the first sealing plate.

The drive wheel and the driven wheel are disposed on the connection plate via a first shaft and a second shaft, respectively; and the first shaft is disposed in the axle hole.

The window comprises a raised sheet tangential to the curved grille.

The deck and the bottom plate are both a continuous plate.

The conveyor belt is a chain structure.

Figure 1:
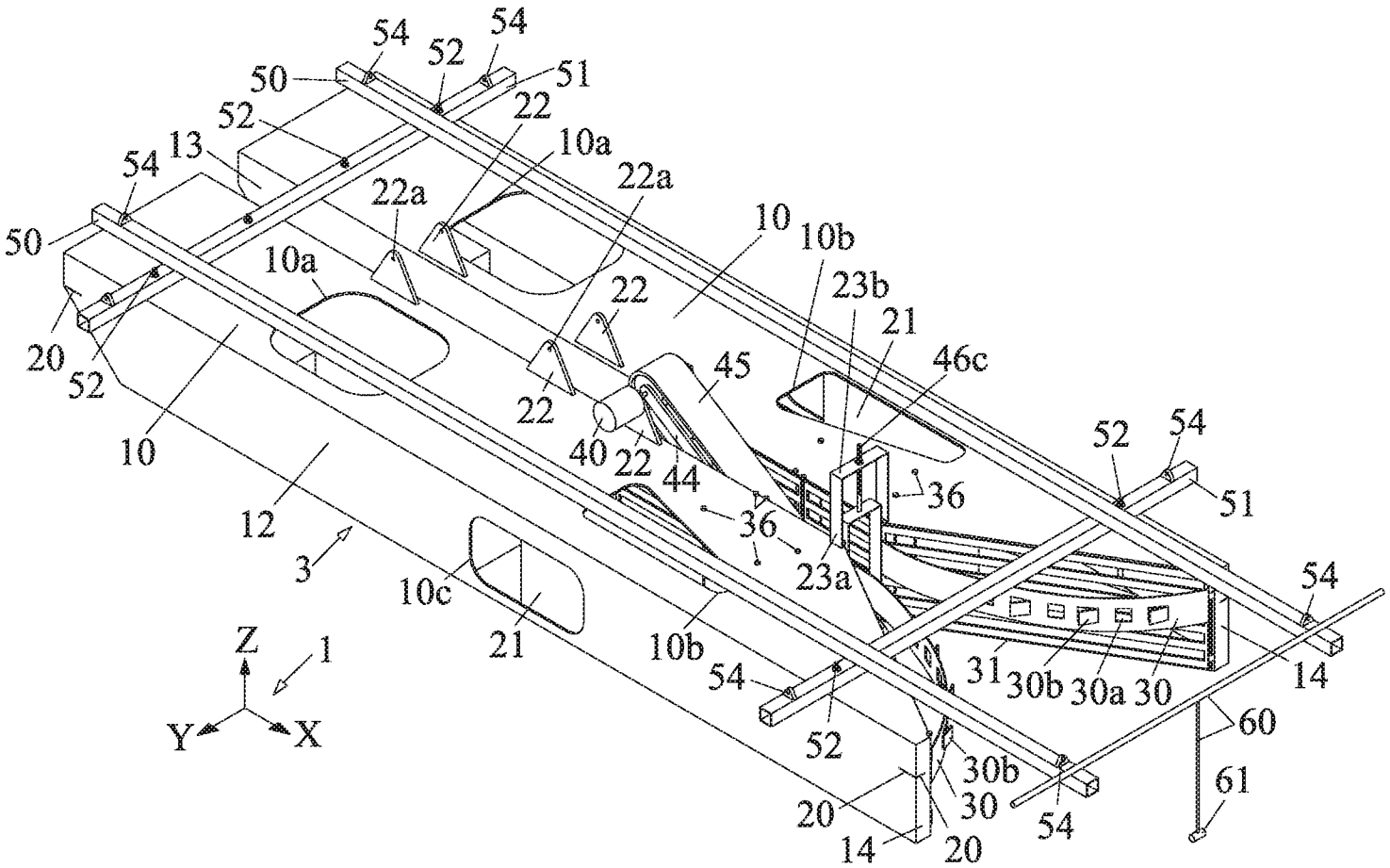
FIG. 1 is a perspective view of a trash skimmer boat according to one embodiment of the disclosure.

In the drawings, the following reference numbers are used: 1. Coordinate system; 2. Surface of water; 3. Pontoon; 10. Deck; 10*a*. Third hole; 10*b*. First hole; 10*c*. Second hole; 10*d*. First slide rail; 11. Bottom plate; 11*d*. Second slide rail; 12. First side plate; 13. Second side plat; 14. First sealing plate; 15. Second sealing plate; 16. Third sealing plate; 17. Bulkhead; 18. Front compartment; 18*a*. Buoyancy module;

19. Rear compartment; 19*a*. Balancing weight; 20. Waterline; 21. Hatch door; 21*a*. First sliding groove; 21*b*. Second sliding groove; 22. Support plate; 22*a*. Axle hole; 23. First square frame; 23*a*. First vertical plate; 23*b*. First transverse plate; 30. Curved grille; 30*a*. Window; 30*b*. Raised sheet; 31. First flat grille; 32. Second flat grille; 33. Third flat grille; 34. Through hole; 35. Hinge pin; 36. Shaft; 40. Motor; 41. Drive wheel; 42. Driven wheel; 43*a*. First shaft; 43*b*. Second shaft; 44. Connection plate; 45. Conveyor belt; 46. Second square frame; 46*a*. Second vertical plate; 46*b*. Second transverse plate; 46*c*. Adjustment screw; 46*d*. Locating screw; 50. Longitudinal bar; 51. Transverse bar; 52. Connecting screw; 53. Nut; 54. Lifting lug; 60. T-shaped frame; 61. Probe.

DETAILED DESCRIPTION

To further illustrate the disclosure, embodiments detailing a trash skimmer boat are described below. It should be noted that the following embodiments are intended to describe and not to limit the disclosure.

Referring to the drawings, FIG. 1 is discussed herein above, showing an example of a trash skimmer boat comprising a hull, a connection member, a transmission, a grille assembly, and a measuring member. A coordinate system 1 is a reference system used to represent the location of every component of the trash skimmer boat, where X represents the boat length, Y represents the boat width, and Z represents the boat shaft.

As shown in FIG. 1, the hull comprises two pontoons 3, and a gap between the two pontoons 3. The two pontoons are symmetrical with respect to the gap. The hull can land on water without sinking, and carries the grille assembly, the transmission, the measuring member to form the trash skimmer boat.

As shown in FIGS. 1, 2, 3, 4, 5, 6, 7, 9, and 10, each pontoon 3 comprises a deck 10, and a third hole 10*a*, a first hole 10*b*, a second hole 10*c*, a first slide rail 10*d*, a bottom plate 11, a second slide rail 11*d*, a first side plate 12, a second side plate 13, a first sealing plate 14, a second sealing plate 15, and a third sealing plate 16, a bulkhead 17, a front compartment 18, a buoyancy module 18*a*, a rear compartment 19, a plurality of balancing weights 19*a*, a waterline 20, a hatch door 21, a first sliding groove 21*a*, a second sliding groove 21*b*, a pair of support plates 22, an axle hole 22*a*, a first square frame 23, two first vertical plates 23*a*, and a first transverse plate 23*b*. Each deck 10 comprises the first hole 10*b* on the front compartment 18, the third hole 10*b* on the rear compartment 19, the pair of support plates 22 each comprising the axle hole 22*a*. The first square frame 23 comprises the two first vertical plates 23*a*, and the first transverse plate 23*b* connecting the two first vertical plates 23*a*. The first square frame 23 is symmetric with respect to the centerline of the hull. The two first vertical plates 23*a* are disposed (but not fixed) on the two decks 10 of the two pontoons 3, respectively. The first square frame 23 cooperates with a second square frame. The bottom plate 11 is a continuous plate structure. The first sealing plate 14 is vertically disposed on the front end of each pontoon and connects the deck 10 and the bottom plate 11. The second sealing plate 15 is vertically disposed on the tail end of each pontoon. The third sealing plate 16 is disposed between the second sealing plate 15 and the bottom plate 11. The first side plate 12 is disposed on the outer side of each pontoon and the second side plate 13 is disposed on the inner side of each pontoon. The first side plate 12 is connected to the deck 12, the bottom plate 11, the first sealing plate 14, the second sealing plate 15 and the third sealing plate 16. The second side plate 13 is connected to the deck 10, the bottom plate 11, the bulkhead 17, the second sealing plate 15 and the third sealing plate 16. The two pontoons 13 each comprises a bulkhead 17 dividing each pontoon into the front compartment 18 and the rear compartment 19. The rear compartment 19 is a watertight compartment and comprises a plurality of counterweights 19*a* that can be manually moved. Each of the balancing weight 19*a* is a variable load whose weight and position are adjustable manually according to a control command from a computer. The two decks 10 each comprise a third hole 10*a* communicating with the rear compartment 19. The third hole 10*a* provides access to monitor the watertight integrity of the rear compartment 19 and to adjust the position of the balancing weights 19*a*. The front compartment 18 is an open non-watertight compartment and comprises a buoyancy module 18*a* used to alter the buoyancy. The weight and position of the buoyancy module 18*a* are adjustable manually according to control commands from a computer. The buoyancy module 18*a* provides buoyancy loads opposite to the gravity exerted by the plurality of balancing weights 19*a*, keeping the trash skimmer boat floating at the waterline 20 and providing balance and stability of the hull. The two decks 10 each comprise a first hole 10*b* communicating with the front compartment 18. The first side plate 12 comprises the third hole 10*c*, and the hatch door 21 capable of moving back and forth to cover and uncover the third hole 10*c*.

A junction of the deck 10 of the first compartment 18 and the first side plate 12 is provided with the first slide rail 10*d*. A junction of the bottom plate 11 of the first compartment 18 and the first side plate 12 is provided with the second slide rail 11*d*. The hatch door 21 comprises the first sliding groove 21*a* receiving the first slide rail 10*d* and the second sliding groove 21*b* receiving the second slide rail 11*d*. The hatch door 10 is movable back and forth by a trashman receiving a control command from a computer, thereby controlling the quantities of water flowing through the second hole 10*c*. The first hole 10*b* provides access to adjust the position of the buoyancy module 18*a* and monitor the flow of water in the first compartment 18.

Figure 5:
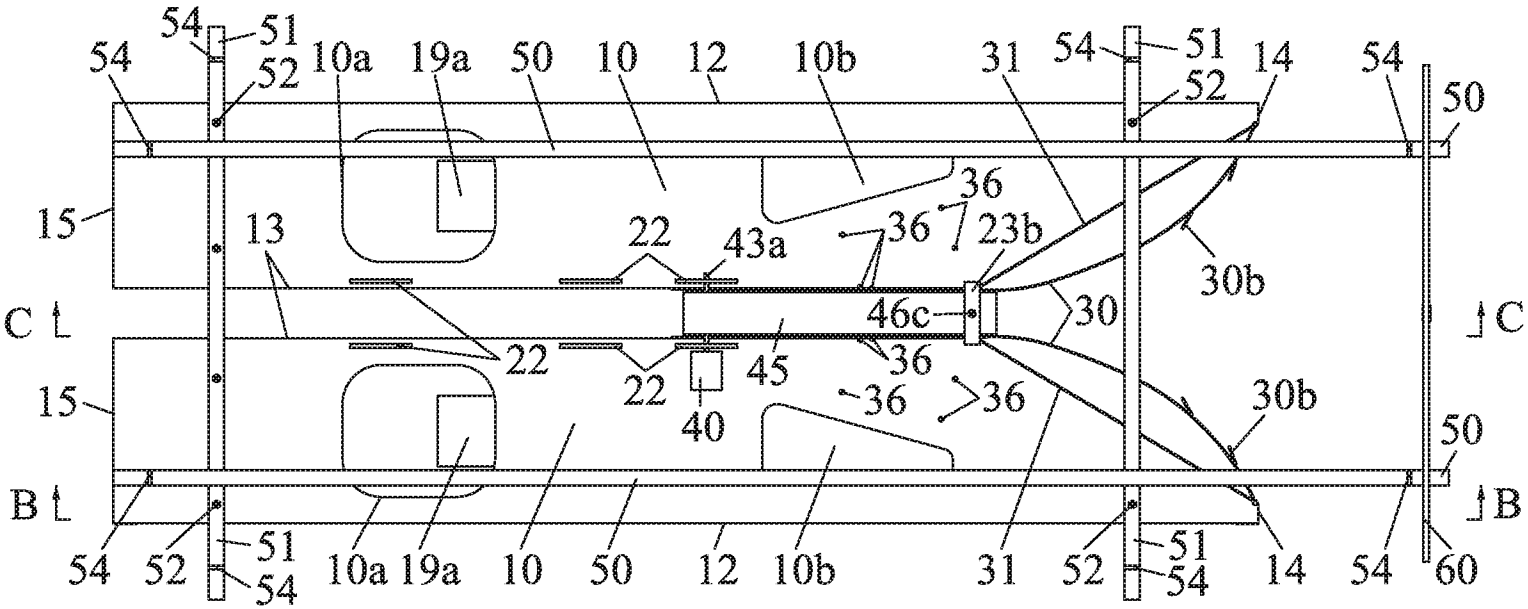
FIG. 5 is a top view of a trash skimmer boat according to one embodiment of disclosure.
Figure 6:
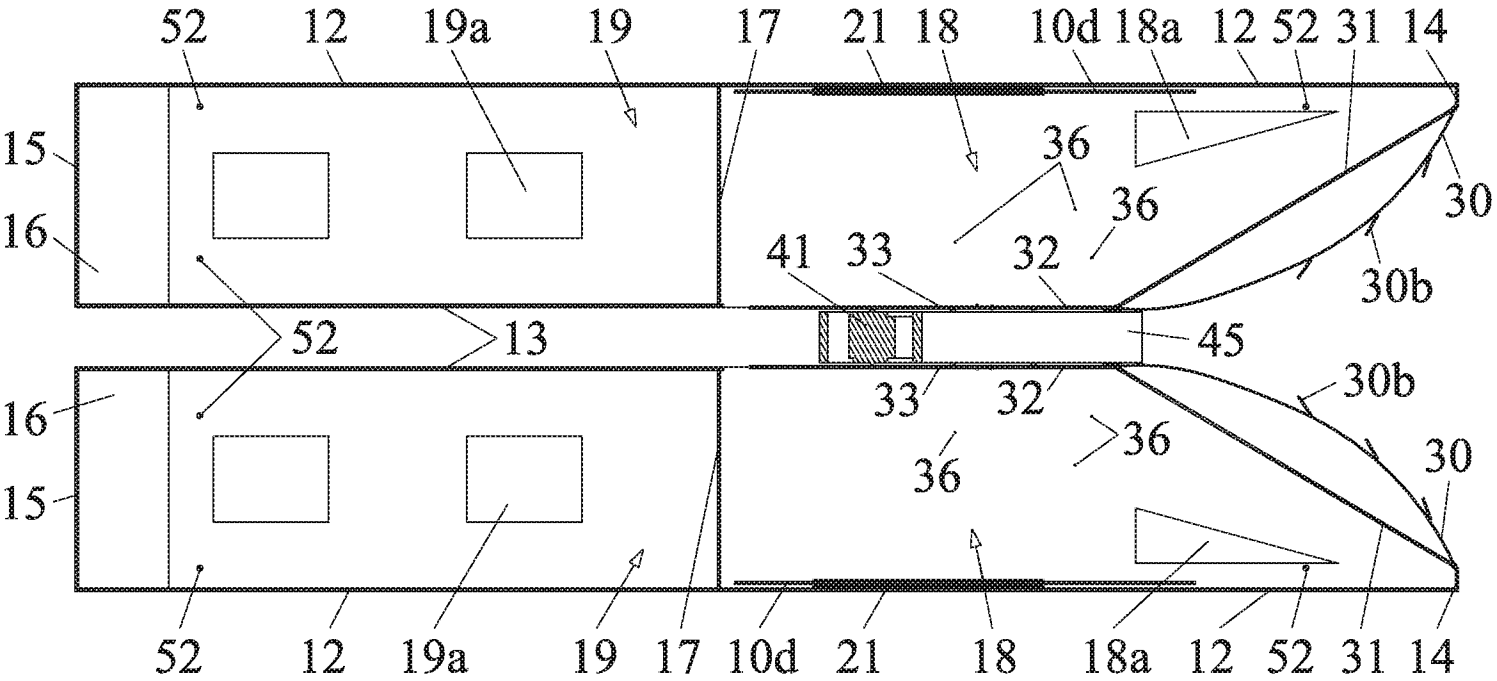
FIG. 6 is a section view taken from line A-A in FIG. 4.
Figure 7:
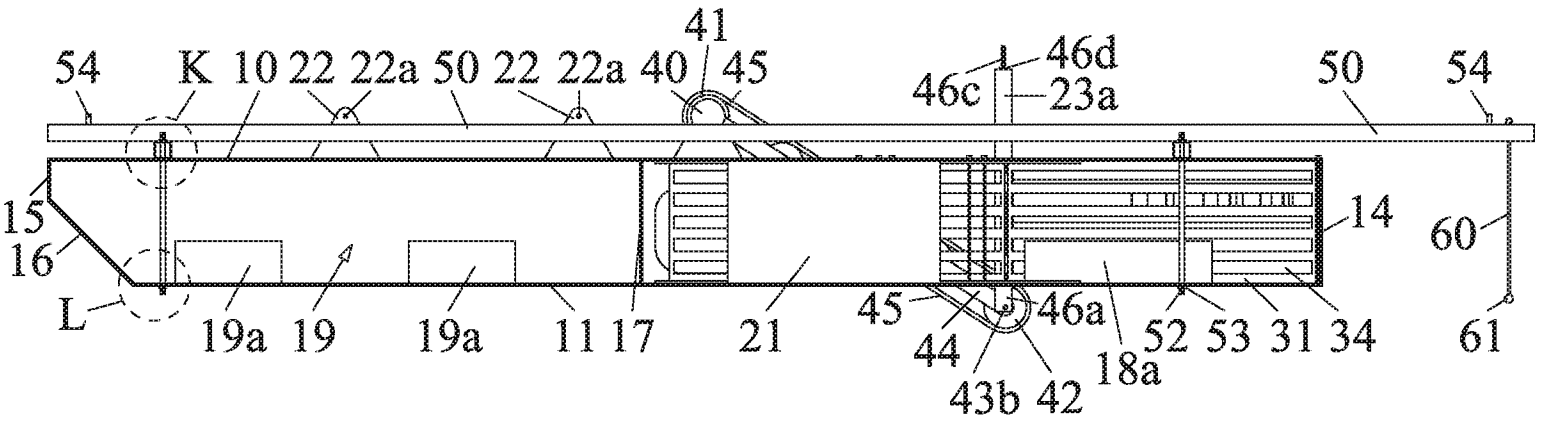
FIG. 7 is a section view taken from line B-B in FIG. 5.
Figure 8:
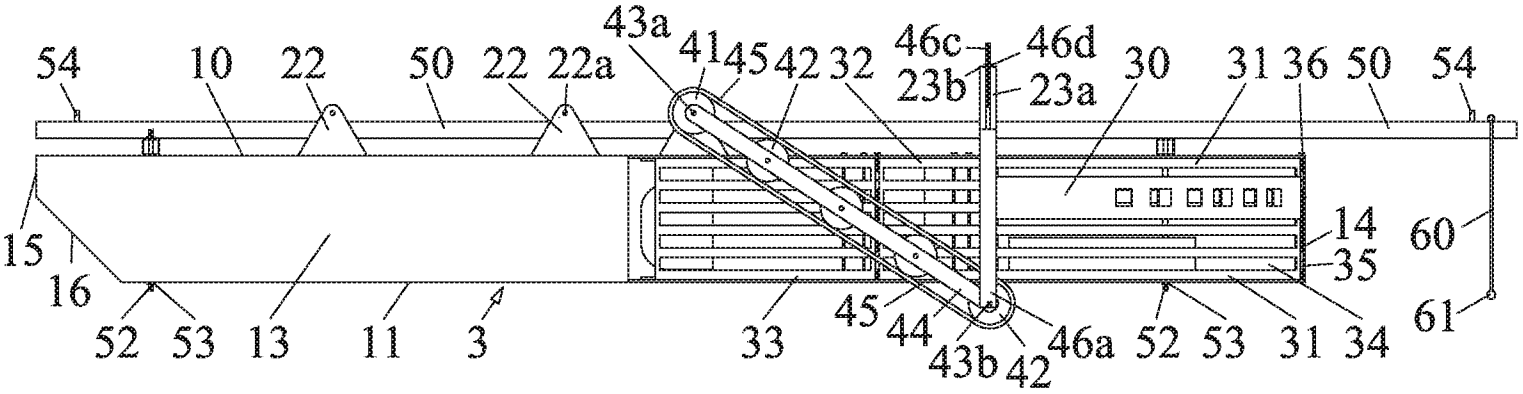
FIG. 8 is a section view taken from line C-C in FIG. 5.
Figure 9:
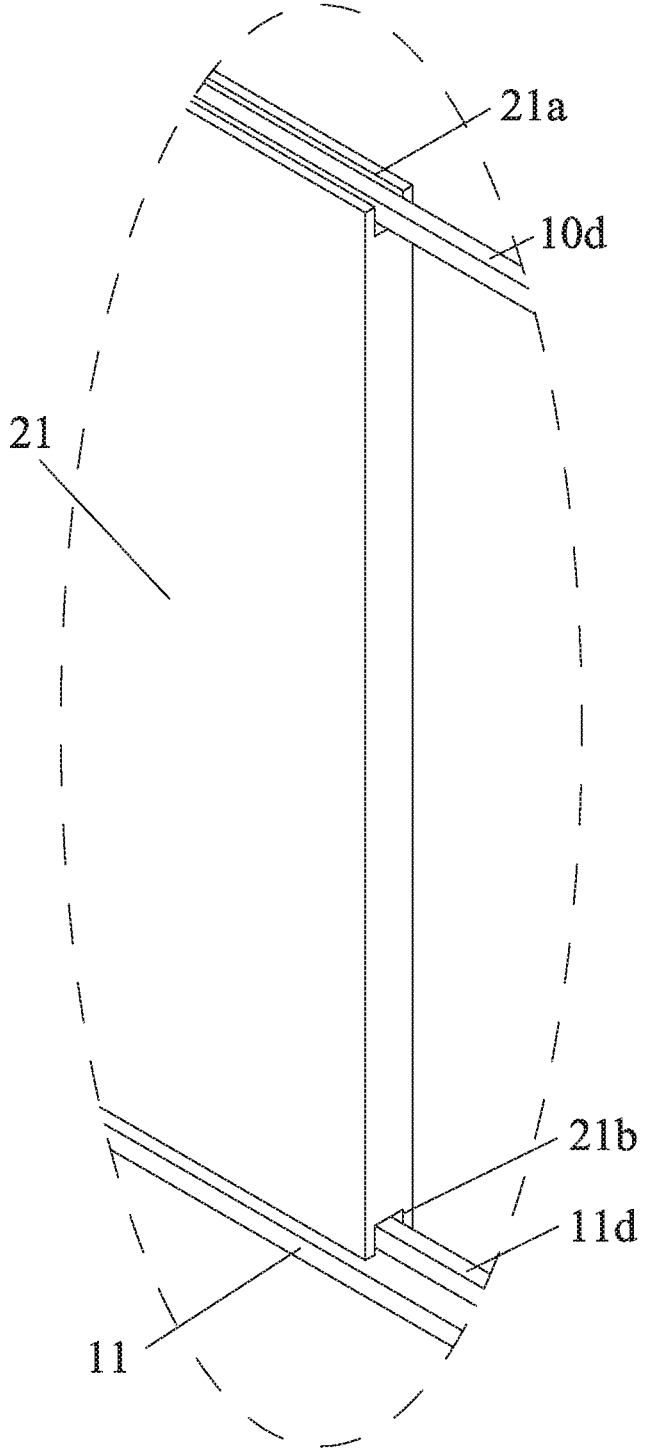
FIG. 9 is an enlarged view of part H in FIG. 2.
Figure 10:
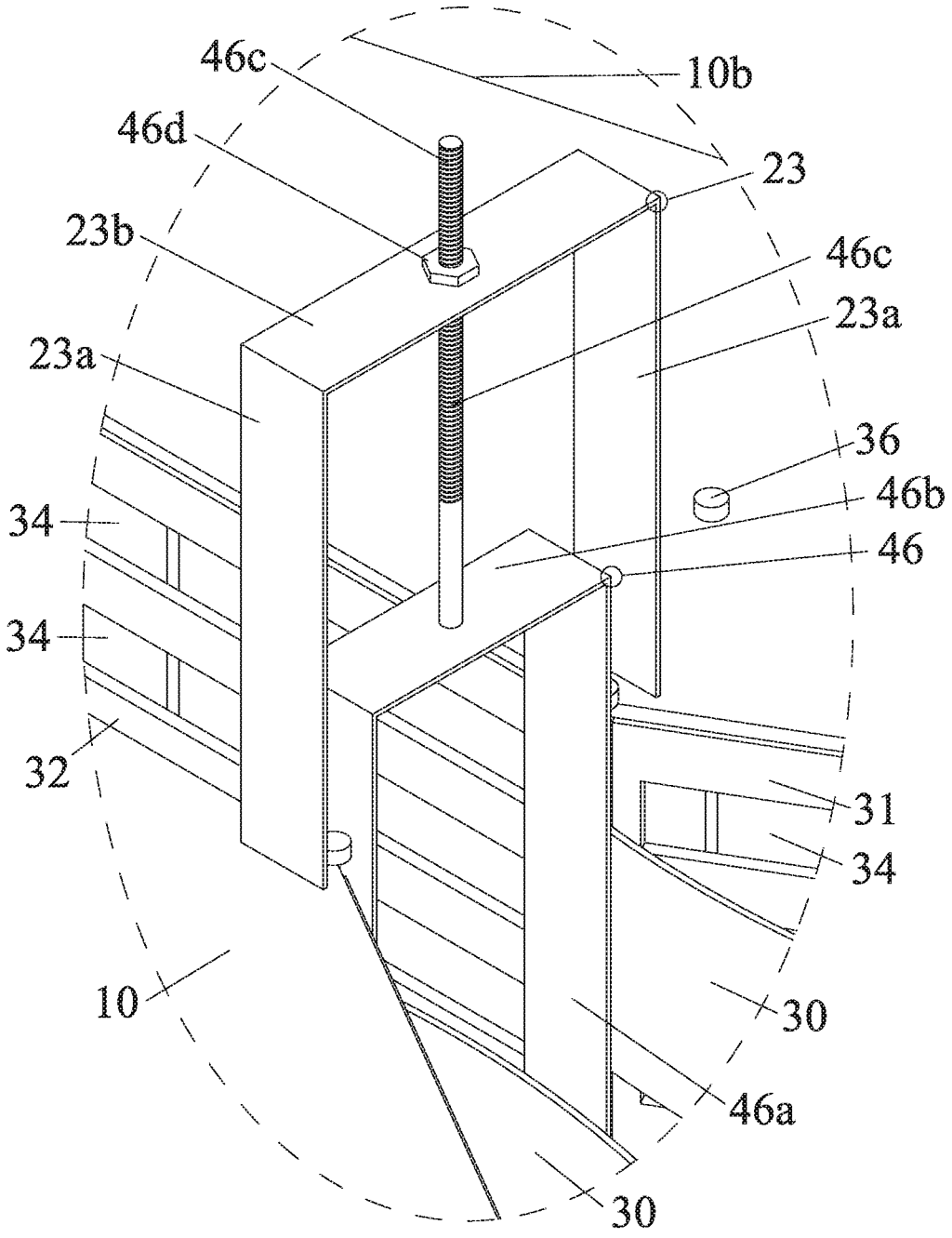
FIG. 10 is an enlarged view of part M in FIG. 2.
Figure 11:
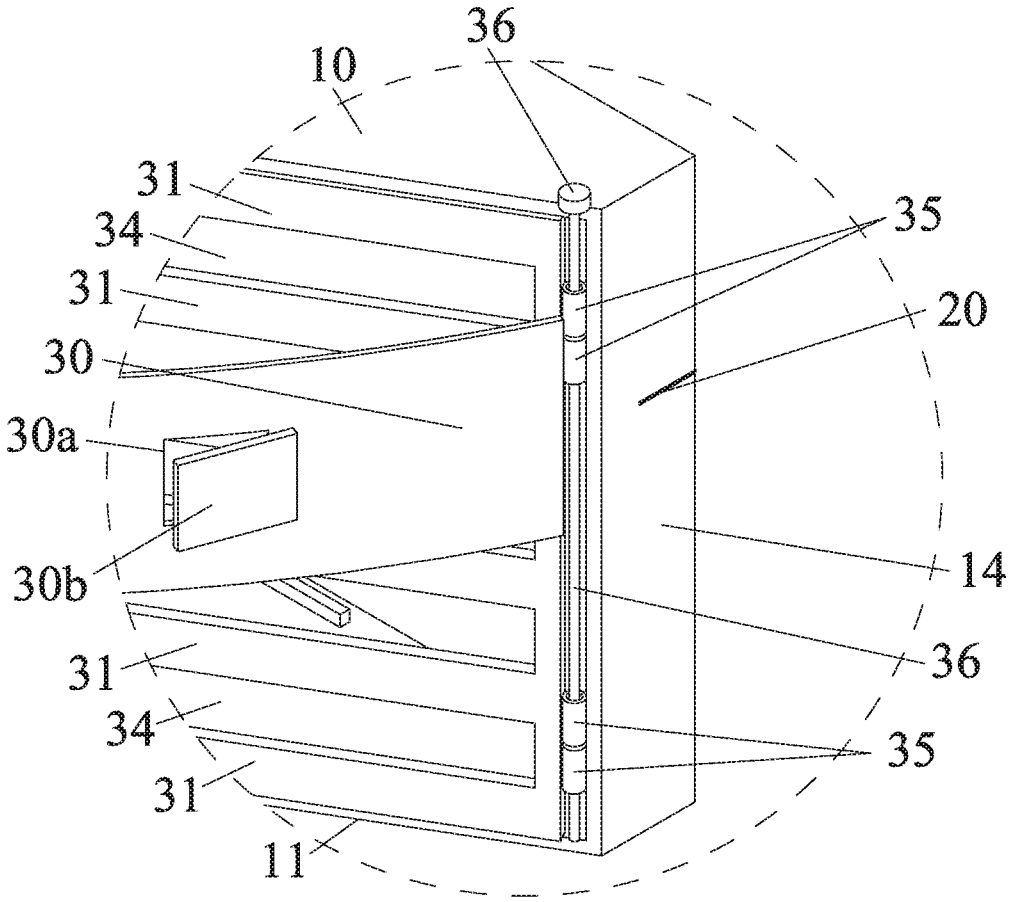
FIG. 11 is an enlarged view of part T in FIG. 2.

Referring to FIGS. 1 and 5, a top view of the trash skimmer boat shows that the hull comprises the two pontoons each covered with the deck 10 providing floor to place equipment. The hull provides sufficient buoyancy and has good seakeeping ability. The hull further comprises a trumpet-shaped opening formed by the two front compartments and communicating with the gap, and the first square frame 23 across the trumpet-shaped opening and connecting the two second side plates 13. The second hole 10*c* of the first side plate 12 is connected to the trumpet-shaped opening, forming a water passage for collecting floating objects. The area of the trumpet-shaped opening decreases leading to the increase of the speed of water near the inlet. One part of water around the trumpet-shaped opening flows through the gap between the two second slide plates 13. Another part of water flows into the front compartment 18 and out of the second hole 10*c*.

Figure 4:
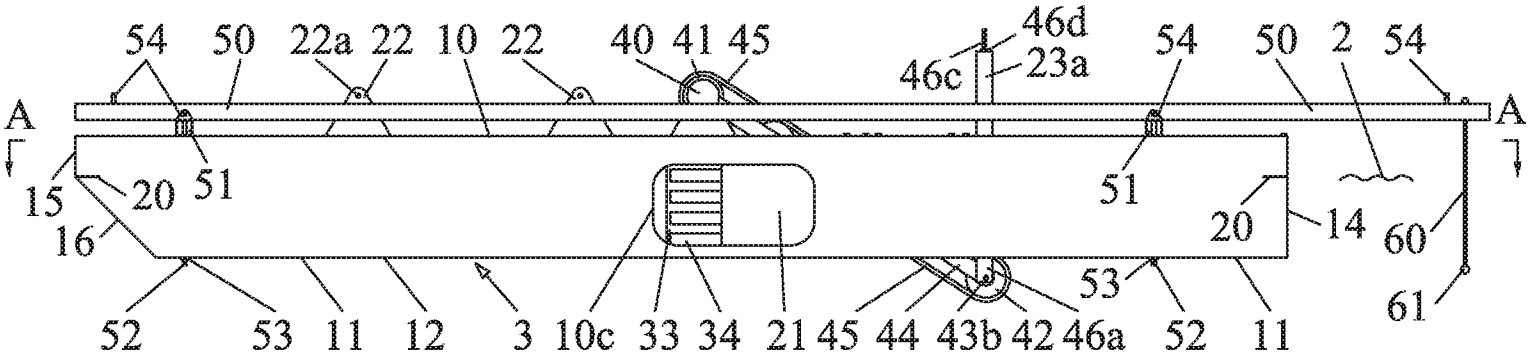
FIG. 4 is a side view of a trash skimmer boat according to one embodiment of the disclosure.

Referring to FIGS. 1 and 4, a left-side view of the trash skimmer boat shows that the hull further comprises a wedge-shaped stern. When the hull is moving, the water flows through the third sealing plate 16 on the stern, decreasing the resistance between the water and the hull, reducing the power required for towing the hull, and being beneficial for the course stability of the towing hull.

Figure 2:
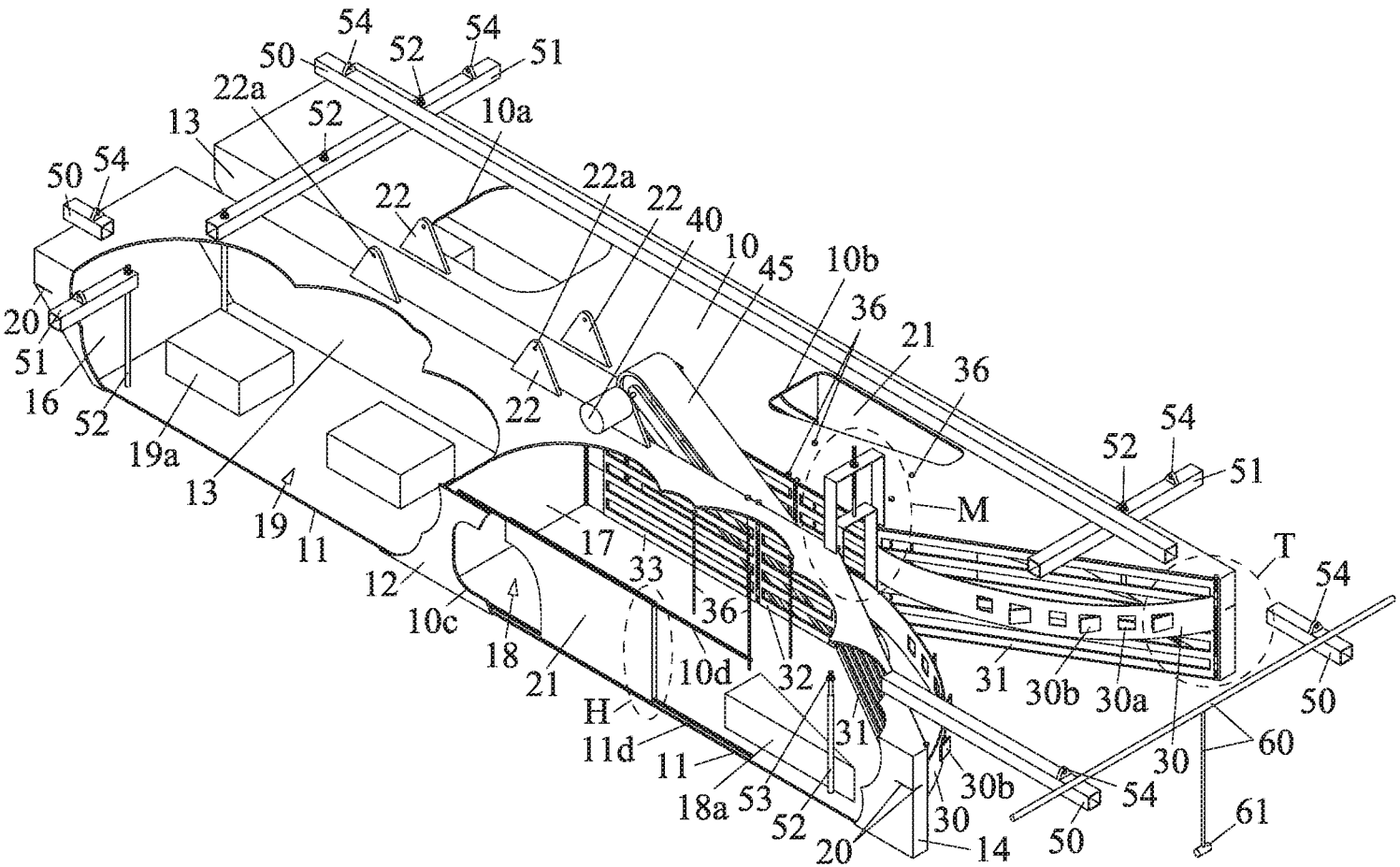
FIG. 2 is a broken-out section view of a trash skimmer boat according to one embodiment of the disclosure.
Figure 3:
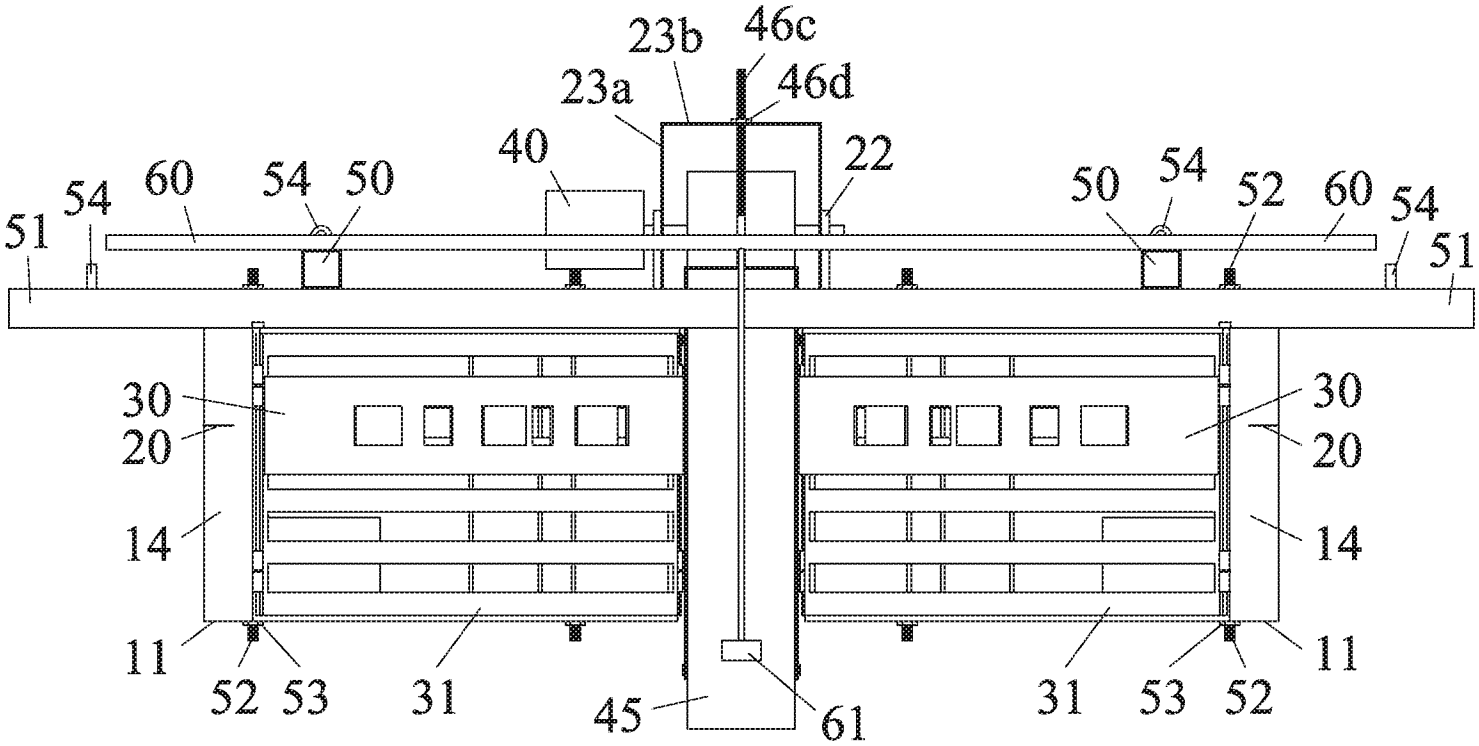
FIG. 3 is a front view of a trash skimmer boat according to one embodiment of the disclosure.
Figure 12:
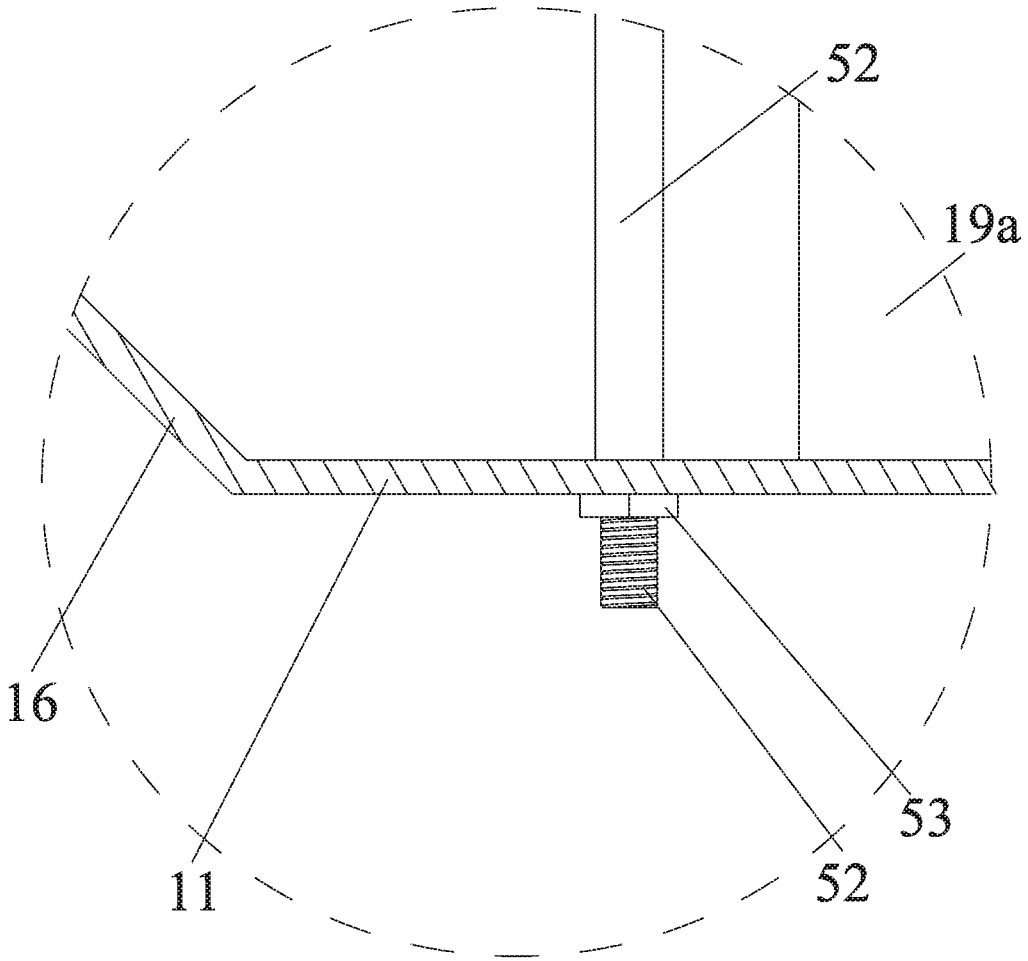
FIG. 12 is an enlarged view of part L in FIG. 7.
Figure 13:
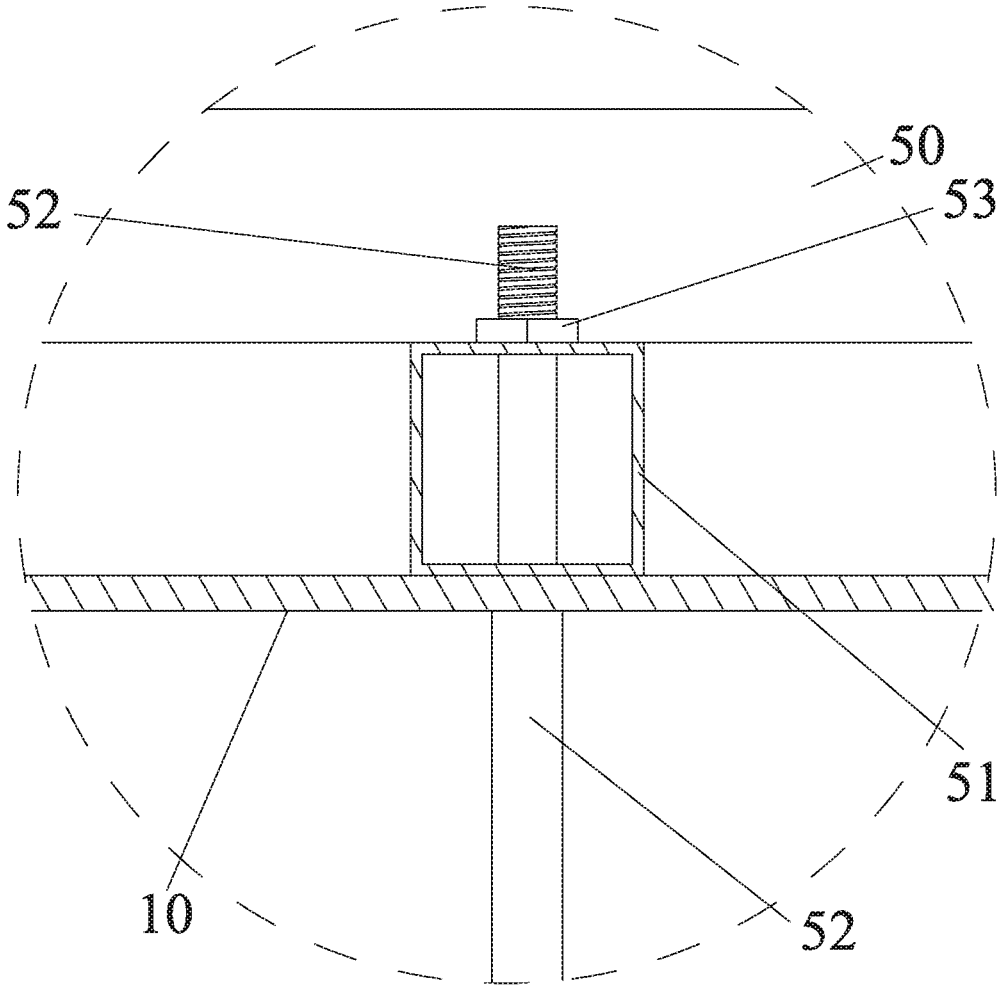
FIG. 13 is an enlarged view of part K in FIG. 7.
Figure 14:
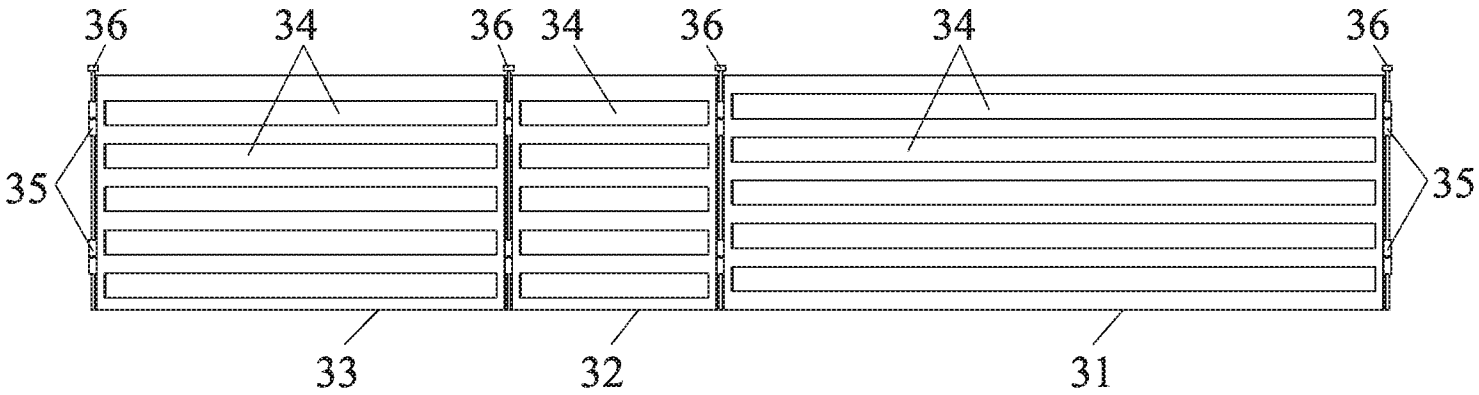
FIG. 14 is a schematic diagram of a flat grille according to one embodiment of the disclosure.

Referring to FIGS. 1, 3, 4, 5, 7, 12 and 13, the connection member comprises two longitudinal bars 50 placed in X-axis, two transverse bars 51 placed in Y-axis, four nuts 53, and four lifting lugs 54, and functions to connect the two pontoons 3 as a catamaran-type floatation hull. The two longitudinal bars 50 are disposed on two decks 10 of the two pontoons 3, respectively; the two transverse bars 51 are disposed on the front compartment 18 and the rear compartment 19 of each pontoon 3, respectively. The two longitudinal bars 50 are secured to the two transverse bars 51 to form an octothorpe-shaped frame. Referring to FIGS. 2, 12 and 13, each transverse bar 51, the deck 10, and the bottom plate 11 are fixed together via connecting screws 52 and the nuts 53. A watertight seal is formed around the fastening position on the bottom plate 11, ensuring the watertightness of the rear compartment 19. Two ends of each of the two longitudinal bars 50 and the two transverse bars 51 are provided with lifting lugs 54, respectively.

Referring to FIGS. 1, 4, 5, 8 and 10, the transmission further comprises a motor 40, a drive wheel 41, a driven wheel 42, a first shaft 43*a*, a second shaft 43*b*, two connection plates 44, a conveyor belt 45, a second square frame 46, two second vertical plates 46*a*, a second transverse plate 46*b*, a plurality of adjustment screws 46*c* and a plurality of locating screws 46*d*. The deck 10 comprises the pair of support plates 22 each comprising the axle hole 22*a*. The first shaft 43*a* is fixed in the axle hole 22*a* of the pair of supporting plates 22, and the second shaft 43*b* is fixedly disposed on the second square frame 46. The drive wheel 41 and the driven wheel 42 are disposed on two sides of the two connection plates 44 via the first shaft 43*a* and the second shaft 43*b*, respectively. The conveyor belt 45 is a chain structure having high water permeability, and is stretched across the drive wheel 41 and the driven wheel 42 to form a loop. The motor drives the drive wheel 41 to rotate around the first shaft 43*a* or the second shaft 43*b*. The rotation of the drive wheel 41 drives the conveyor belt 45 to run centered on the transmission. The second square frame 46 comprises the two second vertical plates 46*a*, and the second transverse plate 46*b* connecting to the two transverse plates 46*a*. The two second vertical plates 46*a* are connected to the two connection plates 44 via the second shaft 43*b*. The second square frame 46 is fixedly connected to the first square frame 23 via the adjustment screws 46*c* and the locating screws 46*d*, thereby precisely adjusting the distance between the two transverse plates by turning the adjustment screws 46*c* and obtaining the transmission with an inclination of 45 degrees upwards.

Figure 15C:
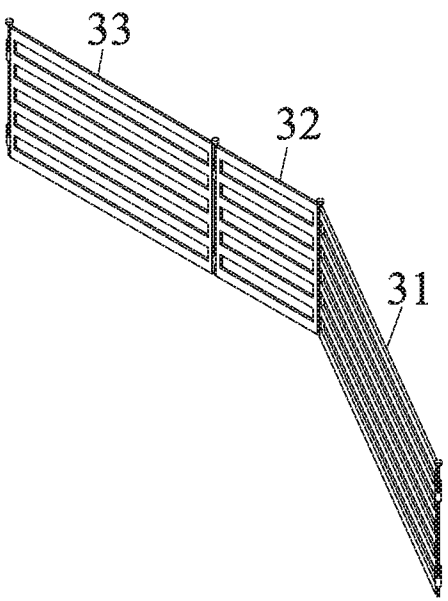
FIG. 15A-15C are schematic diagrams of three kinds of flat grilles according to one embodiment of the disclosure.
Figure 15B:
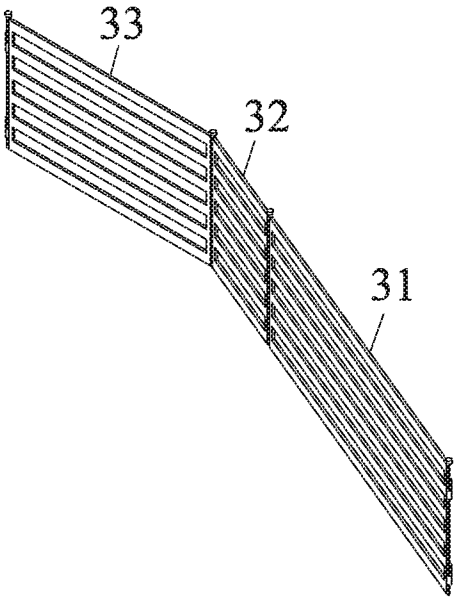
Figure 15A:
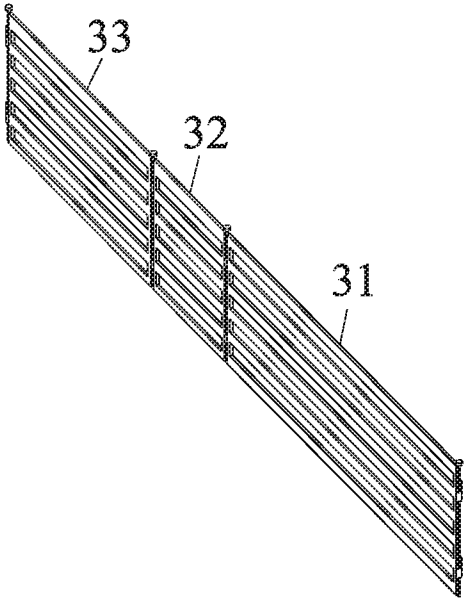

Referring to FIGS. 1, 2, 3, 6, 8, 11, and 14, the grille assembly comprising a plurality of flat grilles and a curved grille, is disposed on the second side plates 13 of the two front compartments 18. The plurality of flat grilles comprises a first flat grille 31, a second flat grille 32, and a third flat grille 33 hinged to each other with a hinge. The hinge comprises a hinge pin 35 and a shaft 36. The deck 10 and the bottom plate 11 both comprise a plurality of through holes 34 at the corresponding position. The shaft 36 passes through the hinge pin 35 and the plurality of through holes 34 to connect every two adjacent flat grilles, so that the plurality of flat grilles is rotatable around the shaft 36, and has three different opening angles. FIG. 15A shows that the first flat grille 31, the second flat grille 32, and the third flat grille 33 lie in the same plane. FIG. 15B shows that the first flat grille 31 and the second flat grille 32 lie in the same plane. FIG. 15C shows that the second flat grille 32 and the third flat grille 33 in the same plane. The first flat grille 31, the second flat grille 32, and the third flat grille 33 each comprises a plurality of windows 34 whose number and shape have effect on the water permeability of the flat grille. The curved grille is connected to the two ends of the first flat grille 31, and disposed at the same height as the waterline 20, effectively reducing the sticking force of the long floatables. The curved grille 30 comprises a plurality of windows 30*a*, some of which comprise a raised sheet 30*b* tangent to the curved grille 30. The windows 30*a* are used to adjust water permeability, and the raised sheets 30*b* are used to reduce the adhesion of the floatables including many plastics to the surface of the grille assembly, so that the floatables can flow to the inlet of the conveyor belt 45 along the trumpet-shaped opening.

Referring to FIGS. 1 and 4, the measuring member comprising a T-shaped frame 60, and a probe 61 disposed at the bottom of the T-shaped frame 60. The T-shaped frame comprises a transverse beam and a vertical beam; the transverse beam is fixed on the two longitudinal bars 50, and the probe 61 is disposed on one end of the vertical beam. The T-shaped frame 60 is movable on the two longitudinal bars 50, and the probe 61 is immersed under the surface 2 of the water to measure the parameters including water velocity, and the measured data is sent to a computer.

It will be obvious to those skilled in the art that changes and modifications may be made, and therefore, the aim in the appended claims is to cover all such changes and modifications.

What is claimed is:

1. A trash skimmer boat for skimming floatables on a water surface, the trash skimmer boat comprising:

a hull, comprising two pontoons; each pontoon comprising a deck, a bottom plate, a first side plate, a second side plate, a first sealing plate, a second sealing plate, and a third sealing plate;

a connection member, the connection member comprising two longitudinal bars and two transverse bars connecting to one another to form an octothorpe-shaped frame;

a transmission, the transmission comprising a motor, a drive wheel, a driven wheel, a connection plate, and a conveyor belt;

a grille assembly, the grille assembly comprising a plurality of flat grilles and a curved grille; and a measuring member, the measuring member comprising a T-shaped frame and a probe;

wherein:

a gap is formed between two second side plates, and the two pontoons are symmetrical with respect to the gap; the two pontoons each further comprises a bulkhead dividing each of the two pontoons into a front compartment and a rear compartment; the hull further comprises a trumpet-shaped opening formed by two front compartments and communicating with the gap, and a first square frame across the trumpet-shaped opening and connecting the two second side plates; the transmission further comprises a second square frame fixedly connected to the first square frame via an adjustment screw;

the two longitudinal bars are disposed on two decks of the two pontoons, respectively; the two transverse bars are disposed on the front compartment and the rear compartment of each of the two pontoons, respectively;

the front compartment is non-watertight and comprises a buoyancy module; the two decks each comprise a first hole communicating with the front compartment; the first side plate comprises a second hole and a hatch door movable back and forth to cover and uncover the second hole;

the rear compartment is watertight and comprises a balancing weight; and the two decks each comprise a third hole communicating with the rear compartment;

the transmission is disposed in the gap between the two pontoons; the drive wheel and the driven wheel are disposed on two sides of the connection plate, respectively;

the deck comprises a pair of support plates; the transmission comprises a first end and a second end; the first end is fixed on the two decks via the pair of support plates; the second end is fixedly disposed on the second square frame;

the plurality of flat grilles comprises a first flat grille, a second flat grille, and a third flat grille hinged to each other; the first flat grille, the second flat grille, and the third flat grille each comprises a plurality of through holes; the curved grille is connected to two ends of the first flat grille; and the curved grille comprises a window; and the T-shaped frame comprises a transverse beam and a vertical beam; the transverse beam is fixed on the two longitudinal bars, and the probe is disposed on one end of the vertical beam.

2. The trash skimmer boat of claim 1, wherein the two longitudinal bars, the two transverse bars, the deck, and the bottom plate are fixed together via nuts; and two ends of each of the two longitudinal bars and the two transverse bars are provided with lifting lugs, respectively.

3. The trash skimmer boat of claim 1, wherein a junction of the deck of the first compartment and the first side plate is provided with a first slide rail; a junction of the bottom plate of the first compartment and the first side plate is provided with a second slide rail; the hatch door comprises a first sliding groove receiving the first slide rail and a second sliding groove receiving the second slide rail.

4. The trash skimmer boat of claim 1, wherein the deck comprises three pairs of support plates; each support plate comprises an axle hole; the first square frame comprises two first vertical plates and a first transverse plate connecting the two first vertical plates; the two first vertical plates are disposed on the two decks of the two pontoons, respectively; a waterline is disposed on two ends of the first side plate and the first sealing plate.

5. The trash skimmer boat of claim 4, wherein the drive wheel and the driven wheel are disposed on the connection plate via a first shaft and a second shaft, respectively; and the first shaft is disposed in the axle hole.

6. The trash skimmer boat of claim 1, wherein the window comprises a raised sheet tangential to the curved grille.

7. The trash skimmer boat of claim 1, wherein the deck and the bottom plate are both a continuous plate.

8. The trash skimmer boat of claim 1, wherein the conveyor belt is a chain structure.

* * * * *